United States Patent [19]

Green

[11] Patent Number: 4,887,924

[45] Date of Patent: Dec. 19, 1989

[54] ANGLED TIP APPLICATOR

[75] Inventor: Richard K. Green, Western Springs, Ill.

[73] Assignee: 501 Blistex Inc., Oak Brook, Ill.

[21] Appl. No.: 157,857

[22] Filed: Feb. 19, 1988

[51] Int. Cl.[4] ..... A47L 13/30; B43K 9/00

[52] U.S. Cl. ..... 401/261; 401/262; 401/266; 222/106

[58] Field of Search ..... 401/261, 262, 266, 49, 401/50, 152, 156, 162; 132/88.7, 79 A, DIG. 3, 317, 320, 333; 222/92, 93, 190, 515, 106, 107, 191

[56] References Cited

U.S. PATENT DOCUMENTS

| | | | |
|---|---|---|---|
| 1,137,086 | 4/1915 | Rodiger | 401/262 |
| 1,170,181 | 2/1916 | O'Kane | 401/266 |
| 1,573,514 | 2/1926 | Hamilton | 401/152 |
| 2,034,137 | 3/1936 | Fitz-Gibbon | 222/92 |
| 2,374,065 | 4/1945 | Worthington | 401/262 |
| 2,604,105 | 7/1952 | Kruck | 132/88.7 |
| 2,630,006 | 3/1953 | Leach | 401/265 |
| 2,636,644 | 4/1953 | Taylor | 222/92 |
| 3,284,839 | 11/1966 | Cook | 401/183 |
| 3,879,141 | 4/1975 | Shulman | 401/183 |
| 4,002,182 | 1/1977 | Michel | 401/202 |
| 4,011,968 | 3/1977 | McGhie et al. | 222/107 |
| 4,265,948 | 5/1981 | Hayes et al. | 222/92 |
| 4,535,906 | 8/1985 | Rowerkamp | 220/288 |
| 4,722,459 | 2/1988 | Goncalves | 401/262 |
| 4,755,075 | 7/1988 | Leem | 401/251 |

*Primary Examiner*—Richard J. Apley
*Assistant Examiner*—D. Crosby
*Attorney, Agent, or Firm*—Myers & Ehrlich, Ltd.

[57] ABSTRACT

An angled plastic tip applicator comprises a compression moulded rigid upper part including a hollow annular tip part being truncated by a convex wall being longitudinally varyingly curved at an impermanent radius. A center tube dependent from the convex wall communicates with an opening in the convex wall. A flat top cap threaded on the tip and having a serrated outer surface has a center pin engageable with the center tube for tight sealing of the applicator. The applicator has a pliable lower metal laminated plastic tubular container wall prevents leaching and pollution of the product.

33 Claims, 1 Drawing Sheet

FIG. 1
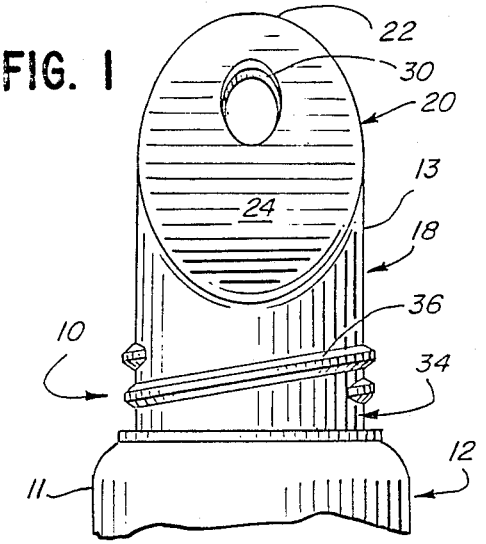
FIG. 2
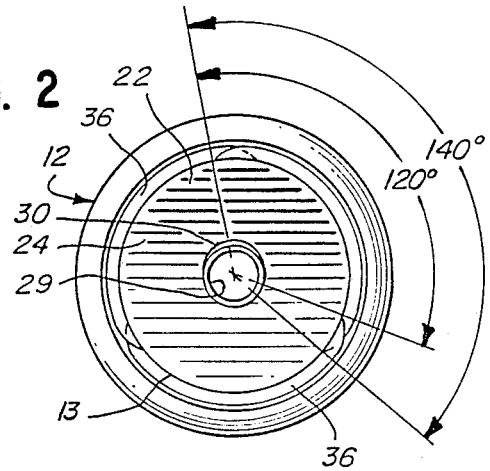
FIG. 3
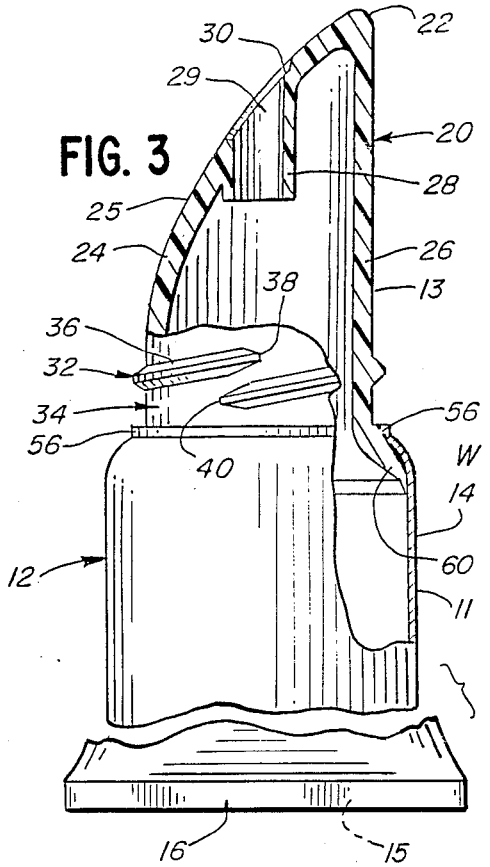
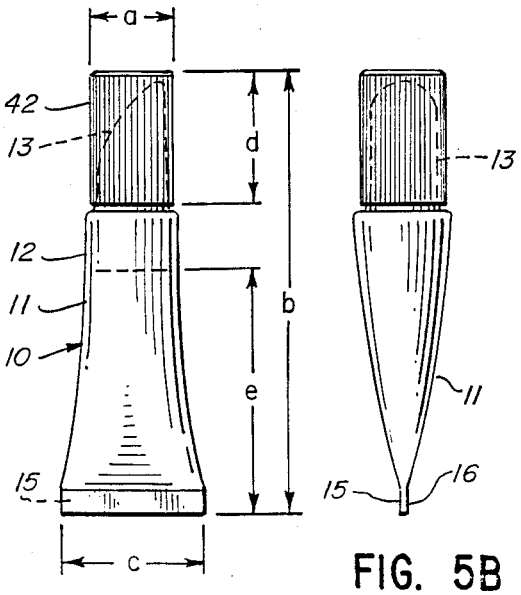
FIG. 5A
FIG. 5B
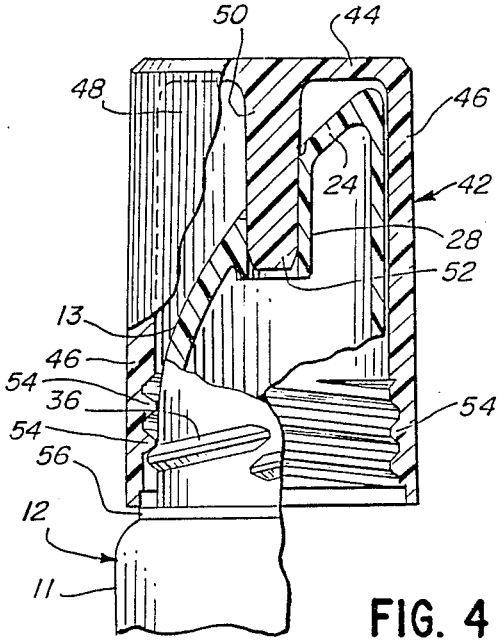
FIG. 4

ANGLED TIP APPLICATOR

BACKGROUND OF THE INVENTION

This invention pertains to viscous substance containers and more particularly to lip balm applicators.

FIELD OF INVENTION

The prior art is replete with various devices for applying cream, lipstick and similar material on lips or a skin. For example, the U.S. Pat. No. 1,137,086, issued to W. Rodiger, disclosed a collapsible tube for containing semi-liquid substances, such as paint, paste, and the like. A cap with the inclined inner surface and a tapered pin projecting therefrom closes an angled nonthreaded nozzle and a nozzle aperture in the flat angled nozzle tip.

Another U.S. Pat. No. 2,344,060, issued to H. S. Ray, teaches a cosmetic holder with a tear-drop shaped inclined mouth for discharge of lipstick or similar substance.

None of the prior art patent references disclose the novel lip balm applicator described in greater detail hereinbelow.

SUMMARY OF THE INVENTION

According to the present invention, a continuously changing angled or curvilinear tip applicator in the form of a laminated metal and plastic tube and includes a rounded rigid tip or head with an angled constantly curving convex spreader wall. A multi-lead external thread on the base of the tip permits quick engagement of the applicator cap with the applicator. The hollow cup-shaped cap has an individually tapering center pin projecting from the cap inside cover wall or bottom for tight sealing of the applicator tube. The compressible or malleable laminated lower container wall portion of the tube is squeezable and prevents leaching of foreign particles into the container or a contained product through the lower container wall and thus preserves the product from pollution. The compression moulded applicator body is provided thereby with an exterior smooth surface. The upper body part is rigid as compared to the lower body part which is squeezable and collapsible but capable of returning to its original shape. The bottom of the lower body part is crimped closed by heat sealing or the like.

It is therefore a general object of the present invention to provide for a balm applicator having an angled tip portion which has a curvilinear or continuously changing curving convex surface which allows for excellent spreading of the balm or ointment salve on the user's lips.

Another object of this invention is to provide an applicator which has an upper or head portion which is provided with three arcuate overlapping threads or leads, wherein each lead extends about slightly greater than a third of a circle in overlapping relation with respect to one another so as to provide for a short turning of a complementary cap threaded on such head threaded surface to provide for rotation of the cap relative to the upper head portion of the applicator body wherein such a turn is only a quarter turn as distinguished from several turns as required by prior art balm applicators.

Still another object is to provide for a shoulder portion between the threaded rigid portion of the tube body and the lower flexible or squeezable part of the tube wherein the shoulder portion accommodates heating sealing or high frequency sealing of the upper body portion and the lower body portion together wherein the lower body portion comprises laminated material which is crimped closed by heat or the like.

It is another object of this invention to provide for an applicator tube body wherein the lower portion of the body is a laminate portion comprising plastic and metal material which acts as a barrier to prevent foreign material outside of the tube from passing to the interior of the tube.

It is still further object of this invention to provide for such laminated structure of metal and plastic wherein the metal may be aluminum and the plastic material may be a polyethylene or polypropylene material.

It is another object of the invention to provide for a one piece applicator body that is produced by compression moulding as distinguished from injection molding and thereby providing for a smooth exterior surface relative to the type of exterior surface produced in an injection moulding operation.

It is another object of this invention to provide an applicator cap for the applicator body wherein the applicator cap is provided with an annular plunger sealing member which is tapered at its end to provide for effective lead into and through the opening of the angulated wall of the applicator body and into the internal tubular wall which is small enough to fit snug around the applicator plunger member.

Another object of this invention is to provide for a one piece continuous body wall for the body of the applicator there being no parting wall but rather a smooth body surface to the applicator body.

It is still another object of this invention to provide for a applicator which has a longer length relative to its annular or round cross section and yet which the applicator is of small size and readily fits in a pocket in a blouse or shirt or the like without bulging in the pocket. Such arrangement provides for ease of handling and makes for an applicator that is small and compact and comfortable to use and store.

These and other objects will become more apparent from a reference to the following description of the drawings and the description of the below preferred embodiment.

BRIEF DESCRIPTION OF THE DRAWINGS

FIG. 1 is a side view of an embodiment of the novel angled tip applicator;

FIG. 2 is a top view of the embodiment shown FIG. 1;

FIG. 3 is a partially cross-sectional view of the embodiment of FIG. 1;

FIG. 4 is a partially cross-sectional view of the embodiment of FIG. 1 assembled with a cap, and;

FIGS. 5*a* and 5*b* are true size views of the applicator at different orientations.

DESCRIPTION OF THE PREFERRED EMBODIMENT

Referring now to the drawings (particularly FIGS. 1–3) wherein reference characters designate like or corresponding parts throughout several views. A balm applicator 10 comprises a collapsible tubular container 12 having lower and upper body portions 11 and 13 respectively, for storing semi-liquid substances, such as ointment or cream used as balms or salves. The container laminated tube wall 14 of the lower body portion 11 is made of a laminated material comprising layers of aluminum foil and plastic such as polyethylene or polypropylene. The chemical formula for a type of material used in the lower body portion is Laminate Web No. 4315S-Surface Printed:

| Structure: | |
|---|---|
| Polyethylene | 110 microns |
| Co-Polymer | 45 microns |
| Aluminum Foil | 40 microns |
| Co-Polymer | 40 microns |
| Polyethylene | 75 microns |
| | 310 microns |

The bottom portion 16 of lower 11 body tube portion of the container 12 which is flexible and squeezable and is crimped and sealed by application of heat and/or pressure to the bottom crimped edge 16 of the container as by heat sealing or high frequency sealing. As seen in FIG. 5*a*, the bottom end of portion 16 portion 11 is flared, as shown at "C", as a result of the crimping of the bottom end portion. The laminated tube wall 14 acts as a membrane or barrier to the entrance of foreign particles to the inside of the portion 11 as could otherwise occur as by leaching. The plastic laminated tube part 14, conforms to the person's squeeze, in that it permits liquid quantity from the tube to be squeezed in a manner where the tube expands to its original shape.

The upper body portion 13 includes a rigid plastic applicator head 18 that is secured to the portion 11 and includes a tip 20 rounded at the top 22. The head 18 also may be made of polyethylene or polypropylene or the like. The tip 20 has a truncated cylinder configuration. A convex (in a longitudinal direction) angled wall or a spreader or ointment applicator wall 24 truncates the cylindrical body of the head 18. The vertical wall 26 merges with a curvilinear angled spreader wall 24 at the top 22. The outer surface 25 of wall 24 is curvilinear or curving in an ever changing slope to allow for easy spreading of the ointment on the lips. Further, the changeable radius curvature or continuously changing angle of the sloped spreader wall 24 facilitates even distribution of substance squeezed out from the container 12 through a center tube 28 which depends inwardly from the spreader wall 24. The passage in Center 28 resembles a truncated cylinder and has an upper opening or orifice 29 which is circumscribed by a beveled recess or well 30 in the exterior of the spreader wall 24.

A multi-lead external thread 32 on the base 34 of the head 18 comprises three separate peripherally spaced apart spiral ribs 36. Each of the ribs encircles the base within the 140 degree range. Leads begin at a 120 degree interval as best shown in FIG. 2 and extend 140 degree in an arcuate path. Ends 38, 40 of each rib 36 overlap each other 20 degree in a vertical plane. Such multi-lead arrangement permits quick seating of a cap 42 (see FIG. 4) on the applicator head 18 which cap 43 has complementary threads 54 to cooperate with leads on ribs 36 of thread 32. It takes approximately one-third turn to close the applicator as distinguished from other ointment applicator caps which require two full turns to close the applicator. The cup-shaped cap 42 has a flat top wall 44 which extends normal to the axis of the cap and an annular side or cylindrical wall or skirt 46 of substantially uniform thickness but thicker than the lower laminated container wall 14. The outer surface of the cap wall is serrated by upright or longitudinally extending parallel ribs or fins 48 which provides positive finger grip.

The center pin 50 projecting inwardly from the top wall 44 has a tapered end 52 penetrating the spreader wall opening 29 and into the tube passage 28 which snugly fits around the pin 50 in closed position. The center pin 50, tapered toward its free end 52, facilitates quicker alignment and orientation of the cap as to the applicator head 18, and tight sealing of the opening 29 and passage 28. The internal thread 54 of the cap engages with the external multi-lead thread 32, which upon turning of the cap causes the bottom edge of the annular wall 46 to abut a circular head shoulder 56. The head shoulder 56 running at the base of the head overlaps the container wall 14, the upper portion of which is rigidly secured by thermal welding to the base depending from the shoulder 56 as by heat sealing or high frequency sealing. It has been found that a rigid transition region is obtained at 60 when the user normally initially grasps the applicator. This inhibits collapse of the tube and discharge of the emollient while uncapping the tip head 18. Thus after the cap is removed the user gently squeezes the tube to obtain the proper quantity of emollient. Thus, the upper thicker rigid plastic head 18 is attached to the lower laminated wall 14. As heretofore stated the said laminated wall being flexible is squeezable by a user to move the material within the container from the lower portion thereof to the upper portion.

Some further novel features of the invention include the following.

The compression molded one-piece head 18 of the applicator eliminates a parting line, or a flash line which usually remains in a rough injection molding, and creates a smooth outer surface of the applicator head 18 alternatively injection molding is used. The laminated container wall 11 preserves the container contents from outside pollution and increases the shelf line of the product. The center pin tight engagement with the center tube further prevents communication of the product with the outside environment and blocks accidental discharge of the substance squeezed out through the center opening.

Furthermore, the constant curving of the outer convex sloping surface of the applicator head portion 18 of the applicator causes a slight indentation into the lip of the user to insure adequate coating of the convex contents of the applicator container upon the lips of the user. The outer ring shoulder 56 in its downward lip extension 60 is welded at W to the lower container wall 14 and thus, the upper thicker rigid plastic head 26 is attached to the lower laminated wall 14, the said laminated wall being flexible and squeezable by a user to move the material within the container from the lower portion thereof to the upper portion. Further, as best seen in FIGS. 5*a*, 5*b*, the applicator has a longer length relative to its diameter and as seen in FIG. 5*a* the distance a is about half an inch, whereas the distance b is about three inches and the distance c is approximately $\frac{7}{8}$ of an inch and the distance d is approximately $\frac{7}{8}$ of an inch whereas the distance e is approximately $\frac{5}{8}$. This illustrates that the overall length d is approximately slightly more than three times the extent of the width c and usually not greater than four times the length of the container. This provides for an ease of handling and makes for an applicator that is small and compact and comfortable to use and to store. FIG. 5*b* illustrates that the crimping portion 16 at the end 15 of the applicator tube causes the longitudinal extent of the applicator to have a sloping or tapering end portion that is about ⅔ or ¾ of the extent of the lower container portion exclusive of the head portion of the tube. It will become readily apparent that the construction of the cap is compatible with the structure of the tip 20. As best seen in FIG. 4, the wall 44 and its placement allows the cap to be screwed down tightly so that the lower edge of the skirt can seat tightly against the shoulder 56. Furthermore the triangular space between the top wall 44 of the cap permits any emollient to remain on the face 25 of the applicator which would rub off if the top wall were to conform to the face 25. Actually, if the top wall 44 of the cap was slanted, the cap could not be screwed on but would have to be telescoped on and could be accidentally removed. Thus possibly exposing the tip and smearing the customer's purse or garment.

While one embodiment of the invention has been illustrated and described herein, various changes and modifications may be made therein without departing from the spirit of the invention as defined by the scope of the appended claims.

What is claim is:

1. An angled tip emollient applicator comprising an upper rigid hollow tip;

a collapsible annular container having a generally cylindrical wall forming a pliable tube having a sealed bottom end;

said rigid tip having a base secured to the upper end of the tube and having a vertical wall and an angled wall truncating said vertical wall;

said angled wall having a curvilinearly convex shape in a longitudinal direction;

a multi-lead external thread encircling said base;

discharge opening located in said angled wall; and said pliable tube communicating with said opening and depending from said base, and weld-connected thereto and forming a relatively rigid transition region adapted for grasping by the user thereby preventing deformation of the tube prior to removal of the cap and preparatory to application of emollient after removal of the cap;

said tube being expandable to draw excess emollient into the tube attendant to the user releasing pressure thereon.

2. The applicator of claim 1, and a cap threadably engageable with said rigid tip;

said cap having a cup-shaped configuration;

said cap having an internal thread at an outer edge thereof.

3. The applicator of claim 2, and said cap including a top wall normal to the axis of said opening and spaced axially of said angled wall closure;

said cap having a pin projecting into said cap from said top wall and extending into said opening.

4. The applicator of claim 2, and said pin being tapered toward its free end; and said thread including leads staggered circumferentially at approximately a 120 degree interval.

5. The applicator of claim 1, and a recessed well encircling said opening adopted to hold excess emollient therein.

6. The applicator of claim 1, and said applicator tip terminating in a rounded top of said vertical wall, and said external thread located in an area between said angled wall and said base.

7. The applicator of claim 1, and said applicator tip having a substantially uniform thickness; and said applicator tip being compression molded.

8. The applicator of claim 1, and a hollow cap threadably engageable with said applicator tip;

a circular shoulder protruding from said applicator base and cooperating with said cap to limit rotatable displacement thereof and effecting tightening of said cap there against.

9. The applicator of claim 1, and said base including a depending lip underlapping and merging with the top of said container wall and bonded thereto.

10. An elongated angled tip applicator for storing and dispensing semi-liquid substances, and comprising:

an axially extending annular tip and an angled wall truncating said annular tip having a discharge opening;

an applicator base merging with one end of said tip;

said angled wall being convexed at impermanent radius and extending adjacent to said base to provide an extensive application surface at one side of the tip;

said angled wall having an opening coaxial with an axis of said applicator;

a tube of slightly larger diameter than said tip dependent from said base and communicating with said opening;

a multi-lead external thread encompassing said applicator base;

a hollow cap having an end wall at one end and an internal thread at the other end engaging with said external thread for closing said applicator;

a pin projecting from said cap and tightly sealing said tube upon insertion thereof into said discharge opening and;

a shoulder at the applicator base limiting rotational displacement of said cap attendant to closing of said applicator.

11. The applicator of claim 10, and each of said leads encircling said base within generally a 140 degree range; and ends of each lead overlapping each other axially of the applicator.

12. The applicator of claim 10, and said cap having an outer surface being serrated by a series of parallel ribs; and said cap, in the closed position, having a top wall spaced axially from the angled wall.

13. The applicator of claim 10, and a tubular lower container wall, said applicator base including a shoulder supporting and integrally merging with said container wall.

14. The applicator of claim 10, and said tip having a rounded top;

said pin tapering toward its free end; and said multi-lead thread comprising three leads beginning at generally 120 degree intervals.

15. The invention according to claim 1, and said applicator angled wall having a continuously changing curvilinear shape.

16. The invention according to claim 1, and said applicator being made of plastic.

17. The invention according to claim 16, and said plastic being selected from the group comprising polyethylene; and polypropylene, and said tube being collapsible to discharge the emollient and being expandable from its collapsed state for aspirating the emollient into the tube upon its being released.

18. The invention according to claim 16, and said plastic being polyethylene.

19. An angled tip applicator comprising a hollow upper rigid tip including a base;

a collapsible annular container having a cylindrical wall with a sealed bottom end;

said rigid tip comprising a base and a vertical wall extending from the base and an angled wall truncating said vertical wall;

said angled wall having a curvilinearly convex shape in a longitudinal direction for a major portion of the length of said vertical wall;

thread means encircling the tip adjacent said base;

a discharge opening in said angled wall;

said container defining with said cylindrical wall a rigid section at the base and a pliable tube depending from said base and communicating with said opening;

means interconnecting the tip and the container and said angled wall extending from adjacent said base to the outer end of the tip.

20. The invention according to claim 19, and said said interconnecting means being a heat seal.

21. The invention according to claim 20, and said interconnecting means comprising electrically generated high frequency heating means.

22. The invention according to claim 21, and said thread means including a plurality of thread leads, each lead overlapping an adjacent thread.

23. The invention according to claim 22, and said plurality of threads being three and each thread having an arcuate extent of at least approximately 140 degrees.

24. The invention according to claim 23, and said arcuate extent being approximately 140 degree.

25. The invention according to claim 19, and said container comprising a chemical composition of plastic material from the group of polyethylene and polypropylene.

26. The invention according to claim 25, and said chemical composition comprising polyethylene.

27. The invention according to claim 26, and said composition including a mixture comprising aluminum.

28. The invention according to claim 27, and said aluminum being laminated with the plastic material.

29. The invention according to claim 19, and said container being of metal and plastic including the following formulation comprising:

| Laminate Web #- 4315S Surface Printed: | | |
|---|---|---|
| Polyethylene | | 110 microns |
| Co-Polymer | | 45 microns |
| Aluminum Foil | | 40 microns |
| Co-Polymer | | 40 microns |
| Polyethylene | | 75 microns |
| | Total: | 310 microns |

30. The invention according to claim 19, and said tip having a thicker deflection-resisting wall than said container.

31. The invention according to claim 19, and said means interconnecting the tip and container comprising a shoulder encompassing the base of the tip and rigidifying the connection therebetween.

32. The invention according to claim 19, and said applicator not exceeding approximately 9 inches in length and 1 inch in width and the dimension of said tip being approximately $\frac{1}{3}$ the length of said applicator.

33. The invention according to claim 19, and said bottom of applicator being flared.

* * * * *

UNITED STATES PATENT AND TRADEMARK OFFICE

CERTIFICATE OF CORRECTION

PATENT NO. : 4,887,924

DATED : December 19, 1989

INVENTOR(S) : Richard K. Green

It is certified that error appears in the above-identified patent and that said Letters Patent is hereby corrected as shown below:

On the title page, item [73] Assignee:

Delete --501--.

Signed and Sealed this

Fifth Day of February, 1991

*Attest:*

HARRY F. MANBECK, JR.

*Attesting Officer*

*Commissioner of Patents and Trademarks*